US006963271B1

(12) United States Patent
Fyffe

(10) Patent No.: US 6,963,271 B1
(45) Date of Patent: Nov. 8, 2005

(54) SYSTEM AND METHOD FOR AN ALARM WITH AROMA SELECTION

(76) Inventor: Ryan David Fyffe, 380 Bedford Dr., Richardson, TX (US) 75080

( * ) Notice: Subject to any disclaimer, the term of this patent is extended or adjusted under 35 U.S.C. 154(b) by 56 days.

(21) Appl. No.: 10/648,965

(22) Filed: Aug. 27, 2003

(51) Int. Cl.[7] ..... G08B 1/00
(52) U.S. Cl. ..... 340/309.2; 340/306.16; 340/309.3; 368/10; 368/244
(58) Field of Search ..... 340/309.16, 332, 340/309.2, 326, 309.3; 368/10, 12, 72, 244, 368/250, 267

(56) References Cited

U.S. PATENT DOCUMENTS 4,407,585 A * 10/1983 Hartford et al. ..... 368/12
4,573,804 A * 3/1986 Kavoussi et al. ..... 368/12
4,645,353 A * 2/1987 Kavoussi et al. ..... 368/12
5,212,672 A * 5/1993 Loisch et al. ..... 368/79
5,321,669 A * 6/1994 Thayer et al. ..... 368/12
5,995,455 A * 11/1999 Kutosky ..... 368/73
6,712,287 B1 * 3/2004 Le Pesant et al. ..... 239/67

OTHER PUBLICATIONS

Progression Wake Up Clock, Hammacher Schlemmer, © 2003 Hammacher Schlemmer & Company, Inc., http://www.hammacher. com/publish/70460.asp?promo, 3 pages, 2003.

Progression Wake Up Clock, Hammacher Schlemmer, http://www.hammacher.com/publish/66014.asp?promo=gifts, 2 pages, Aug. 6, 2003.

AllScout, Zenith Z358 Aromatherapy Clock Radio, http://www.allscout-electronic.com/Zenith_Z358_Aroma_Therapy_Clock_Zenith_E . . . , 1 page, Aug. 6, 2003.

Timex Aromatherapy Alarm Clock Radio with Nature Sounds, The Alarm Clock Shop, http://www.thealarmclockshop.com/alarm-clock-shop/tiaralclrawi.html, 1 page, Aug. 6, 2003.

Sound Spa Nature Clock, Envira Spa Aroma Machine, SerenityHealth.com, SERENITY—Homedics Sound Spa and EnviraSpa DISCOUNT, http://www.serenityhealth.com/soundspa_clock_aroma.html, 3 pages, Aug. 6, 2003.

* cited by examiner

*Primary Examiner*—Brent A. Swarthout
(74) *Attorney, Agent, or Firm*—Baker Botts L.L.P.

(57) ABSTRACT

A system for waking a person includes an input that receives an alarm time information and an aroma selection from a person, an alarm that generates an audible signal when activated, an aroma station that generates an olfactory signal when activated, an activator that receives a snooze input from the person, and a controller coupled to the activator and the aroma station, where the controller activates the audible signal in response to the alarm time information, and activates the aroma station in response to the snooze input and according to the aroma selection.

18 Claims, 2 Drawing Sheets

SYSTEM AND METHOD FOR AN ALARM WITH AROMA SELECTION

TECHNICAL FIELD OF THE INVENTION

This invention relates generally to alarm systems and more specifically to a system and method for an alarm with an aroma selection.

BACKGROUND OF THE INVENTION

Alarm clocks help people wake up. This process usually involves presetting an alarm clock with a wake-up time. The alarm clock sounds the alarm at the designated wake-up time. A user may mute the alarm using a snooze function, which may prolong or delay the process of waking up. In some instances, a user may fail to wake up if the snooze mechanism causes the alarm to cease completely. Known techniques to ensure an alarm clock's effectiveness may include: brightening a display light on the alarm clock; making different sounds available as alarm sounds; and adjusting the snooze function to require a high level of activity to continue snoozing, such as having to inspect the alarm clock. These known techniques, however, may not be effective because after snoozing, there may not be an additional enticement to get a user to wake-up. For example, after pressing a snooze button, however difficult, the user may continue sleeping.

SUMMARY OF THE INVENTION

In accordance with the present invention, an alarm with an aroma selection provides advantages to alert users of a particular time and encourages users to proceed with their tasks.

According to one embodiment of the present invention, a system for waking a person includes an input that receives an alarm time information and an aroma selection from a person, an alarm that generates an audible signal when activated, an aroma station that generates an olfactory signal when activated, an activator that receives a snooze input from the person, and a controller coupled to the activator and the aroma station, where the controller activates the audible signal in response to the alarm time information, and activates the aroma station in response to the snooze input and according to the aroma selection.

In accordance with another embodiment of the present invention, a method for waking a person, includes receiving an alarm time information and an aroma selection from a person, generating an audible signal in response to the alarm time information, generating an olfactory signal at an aroma station when activated, receiving a snooze input from the person at an activator, and activating the aroma station in response to the snooze input and according to the aroma selection.

Certain embodiments of the invention may provide one or more advantages. For example, a user may stop snoozing an alarm clock by requiring the user to at least partially get up from bed to activate a snooze function that initiates the release of an energizing aroma that may result in the user being energized. With a traditional alarm, a user may not be motivated to perform the required tasks of the day. This device motivates the user to complete daily tasks by releasing an olfactory signal in addition to a traditional auditory signal. This combined alarm both energizes users and alerts the users of a specific time.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its advantages, reference is made to the following descriptions, taken in conjunction with the accompanying drawings, in which.

DETAILED DESCRIPTION OF EXAMPLE EMBODIMENTS

Figure 1:
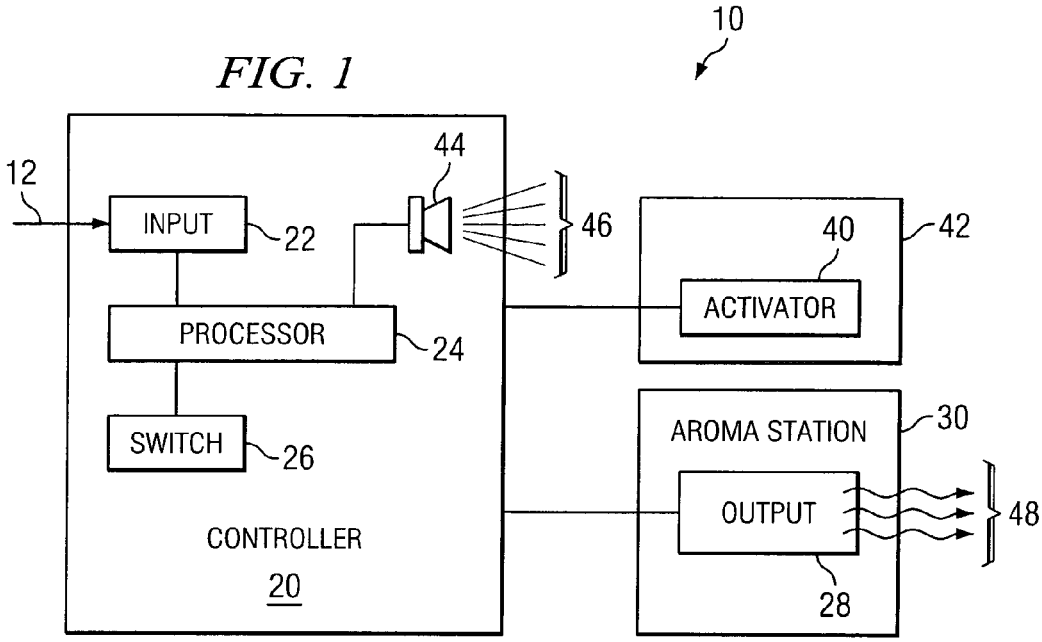
FIG. 1 is a block diagram illustrating an example of a system for waking a person.

FIG. 1 is a block diagram illustrating an embodiment of a system 10 for waking a person. System 10 includes a controller 20 that generates an alarm 46 at an alarm time and initiates the release of an aroma 48 that may energize a user's senses. In general, controller 20 generates alarm 46 at a specified time. An activator 40 receives from a user a snooze input that snoozes alarm 46. Upon receiving the snooze input, controller 20 may initiate the release of aroma 48 at aroma station 30. Controller 20 may be coupled to one or more aroma stations 30 and initiate the release of an aroma at each aroma station 30. System 10 includes a controller 20, one or more aroma stations 30, and an activator 40 coupled as shown in FIG. 1.

Controller 20 includes an input 22 for receiving information 12 from a user. According to one embodiment, input 22 may include alarm setting buttons, snooze setting buttons, aroma selectors, timer selectors, any other suitable selector for inputting alarm time and aroma selections, or some, none, or all of the preceding. Information 12 may include a specified alarm time at which to activate alarm 46, music selection that identifies whether or not to play music, alarm selection that specifies the type of alarm to activate, amount of time to mute alarm 46, or any other information suitable for setting an alarm time that a user may input into controller 20. According to one embodiment, information 12 may also include an aroma selection. The aroma selection may include a selection of one or more aromas 48 that aroma station 30 may emit. According to the illustrated embodiment, the user inputs an alarm time at input 22.

Controller 20 may include a processor 24 that processes information 12 received at input 22. For example, processor 24 may process information 12 received at input 22 by executing instructions that set the alarm time. According to one embodiment, processor 24 may process information 12 comprising a default time that processor 24 may use to set the alarm time. For example, if a user does not input time information at input 22, the alarm may activate at the default time.

Controller 20 receives a snooze input for snoozing alarm 46. Snoozing may include any suspending, muting, delaying, lowering the volume of alarm 46, or any other suitable adjustment of alarm 46. For example, controller 20 may mute the sounding of alarm 46 upon receiving the snooze input from the user. According to one embodiment, controller 20 may include a switch 26 that upon activation may enable processor 24 to receive the snooze input from the user. Switch 26 may include a two-position switch, such as a double toggle switch that has two positions to select an on position and an off position. For example, switch 26 may determine whether the alarm is enabled or suspended. Switch 26 in the on position may enable controller 20 to sound alarm 46 and receive the snooze input, and switch 26 in the off position may disable the sounding of alarm 46 and disable receiving the snooze input at controller 20. Switch 26 may include any suitable device for snoozing alarm 46.

Controller 20 sounds alarm 46 at the alarm time. For example, controller 20 may alert the user at the alarm time by playing music, generating a beeping sound, generating a buzzing sound, vibrating, or generating any other signal suitable for alerting the user of the alarm time. Controller 20 may sound alarm 46 for a predetermined amount of time, until a user takes additional steps, or according to any other suitable criteria. For example, controller 20 may sound alarm 46 at preset intervals.

Controller 20 generates a release aroma signal in response to the snooze input. According to the illustrated embodiment, upon receiving the snooze input, controller 20 generates a release aroma signal for initiating release of aroma 48 at aroma station 30. For example, processor 24 may generate the release aroma signal that directs aroma station 30 to release a selected aroma 48. Controller 20 may generate other suitable signals for directing aroma station 30 to release aroma 48. Controller 20 also includes a speaker 44 that sounds alarm 46. Speaker 44 may comprise a microelectronic speaker such as a piezo speaker. Speaker 44 may include any other suitable device for sounding alarm 46.

Aroma station 30 receives the release aroma signal to release aroma 48. Aroma station 30 includes an output 28 that releases aroma 48 in response to the release aroma signal. According to one embodiment, controller 20 may be coupled to output 28, a processor at aroma station 30, or any other device at aroma station 30 suitable for directing the release of aroma 48. According to the illustrated embodiment, output 28 comprises a vent for diffusing aroma 48. Aroma station 30 is described in more detail with reference to FIGS. 2 and 3.

Aroma 48 includes any aroma suitable for energizing a user's senses, for example by alerting the user, awakening the user, reviving the user, motivating the user, or effectuating any other suitable response from a user. For example, aroma 48 may include a bacon aroma, a coffee aroma, a sausage aroma, a hot chocolate aroma, or any other suitable aroma. According to one embodiment, aroma 48 may be released for a predetermined amount of time. For example, aroma station 30 may be equipped with a timer that may control how long aroma 48 is emitted such as by stopping the emission of aroma 48 after a specific amount of time has lapsed. Aroma station 30 may also emit aroma 48 until the user takes additional steps, or for any other reason that may be suitable to stop the emission of aroma 48. According to another embodiment, aroma station 30 may include additional outputs 28 for emitting any suitable number of aromas 48.

Activator 40 receives a snooze input from a user for snoozing alarm 46. Activator 40 may include any suitable device operable to accept input such as a motion detector, a sound detector, a pressure sensitive sensor, or any other suitable sensing device. According to the illustrated embodiment, activator 40 includes a pressure sensitive pad that a user may step on to generate the snooze input. For example, the user may step on the pressure sensitive pad to snooze alarm 46 which may result in the user at least partially getting up from bed if the pressure sensitive pad is a floor mat located substantially proximate to the bed. Stepping on activator 40 generates the snooze input that activator 40 transmits to controller 20. As was described previously, controller 20 uses the snooze input to snooze alarm 46 and generate the release aroma signal. In that embodiment, activator 40 may be used as a conventional snooze button that entices the user to at least partially get up from bed and, when activated, initiates the release of aroma 48 that energizes the user, which may decrease or eliminate the practice of continually snoozing.

Activator 40 may also include an attachment 42. Attachment 42 comprises an enclosure that may conceal, hold, camouflage, disguise, or suitably cover activator 40. For example, attachment 42 may include a rug, a bath mat, a skateboard, a towel, or any other suitable material. Attachment 42 is suitable to take any shape or form. Attachment 42 may also be removable. If attachment 42 is removable, the user may change the appearance of attachment 42 to match a specific decor. According to the illustrated embodiment, activator 40 is a floor mat enclosed in a fake fur material formed in the shape of a rug that may be placed on the floor by the bedside.

System 10 may be modified, for example, by including several processors 24 at controller 20 to accommodate multiple users of aroma station 30. Controller 20 may also include any suitable number of inputs 22 to receive information 12. As another example, system 10 may include additional controllers 20 to accommodate more than one user of system 10 and multiple inputs of information. Controllers 20 may allow each user to input a specified time into the specific controller 20. As yet another example, controller 20 may receive information 12 comprising the user's aroma selection. Controller 20 may be set with a default aroma selection that system 10 may use to generate aroma 48. As yet another example, controller 20 may include a memory to store information 12. The memory may include any suitable storage device such as an erasable programmable read-only memory (EPROM) that may enable controller 20 to store default inputs and information 12. As yet another example, aroma station 30 may be modified to receive the aroma selection representing the user's selection of aroma 48. Additionally, functions may be performed using any suitable logic comprising software, hardware, other logic, or any suitable combination of the preceding. As used in this document, "each" refers to each member of a set or each member of a subset of a set.

Figure 2:
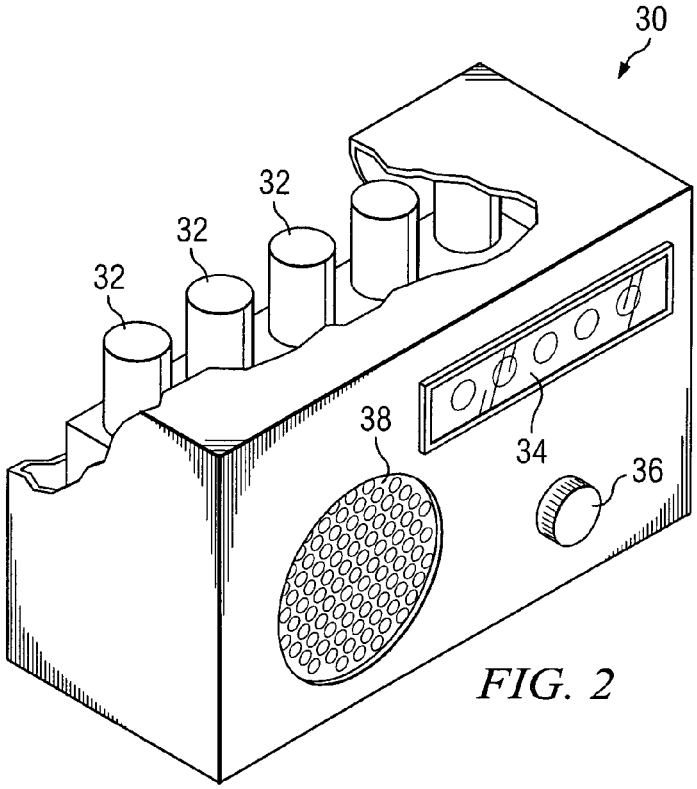
FIG. 2 is a block diagram illustrating one embodiment of an aroma station that may be used with the system of FIG. 1.

FIG. 2 is a block diagram of an embodiment of aroma station 30 that may be used with system 10. According to the illustrated embodiment, aroma station 30 comprises an aroma chamber that houses one or more containers 32. For example, containers 32 may include beakers, vials, tubes, or any other suitable container that may store an aroma releasing material. The aroma releasing material may include oil, paper, textile, paste, gel, beads, or any other suitable material that may emanate an aroma. Such aroma releasing material may emanate any suitable energizing aroma include a bacon aroma, a sausage aroma, a coffee aroma, a hot chocolate aroma, or any other suitable aroma that may energize or awaken the senses of a user. Aroma station 30 may also allow the user to access containers 32 for replenishing the aroma releasing material, replacing containers 32 and aroma releasing materials, and removing containers 32.

Aroma station 30 includes a selector 36. The user may use selector 36 to select a particular aroma 48. For example, selector 36 may include a knob that the user turns to select a specific aroma. As another example, selector 36 may include a push button that the user pushes to select the specific aroma. Selector 36 may include any other suitable device that may allow a user to make an aroma selection.

Aroma station 30 may include an indicator 34. Indicator 34 displays the selected aroma. For example, if the user selects a bacon aroma, indicator 34 may display that the bacon aroma has been selected. According to the illustrated embodiment, indicator 34 comprises a light emitting diode (LED) display that indicates the selected aroma. For example, an LED located proximate to a label or picture indicating that a bacon aroma is available for selection may be illuminated to indicate that the bacon aroma is selected. Other suitable light indicators may be used as indicator 34.

Aroma station 30 comprises a vent 38. Vent 38 diffuses the selected aroma when aroma 48 is released. For example, when the alarm sounds, and a snooze input is received at activator 40, aroma station 30 may release aroma 48 through vent 38. According to one embodiment, aroma 48 may be released by warming the aroma releasing material contained in containers 32. Vent 38 may include orifices, a lid, an opening, or any other ventilation configuration that may allow the released aroma 48 to be diffused. Vent 38 may also diffuse aroma 48 using any other suitable procedure such as by fanning aroma 48. Diffusing aroma 48 through vent 38 at a proximate distance to the user may encourage the user to complete scheduled tasks, awaken and get out of bed, or perform any other suitable event that the user may need to be energized to begin or complete.

Figure 3:
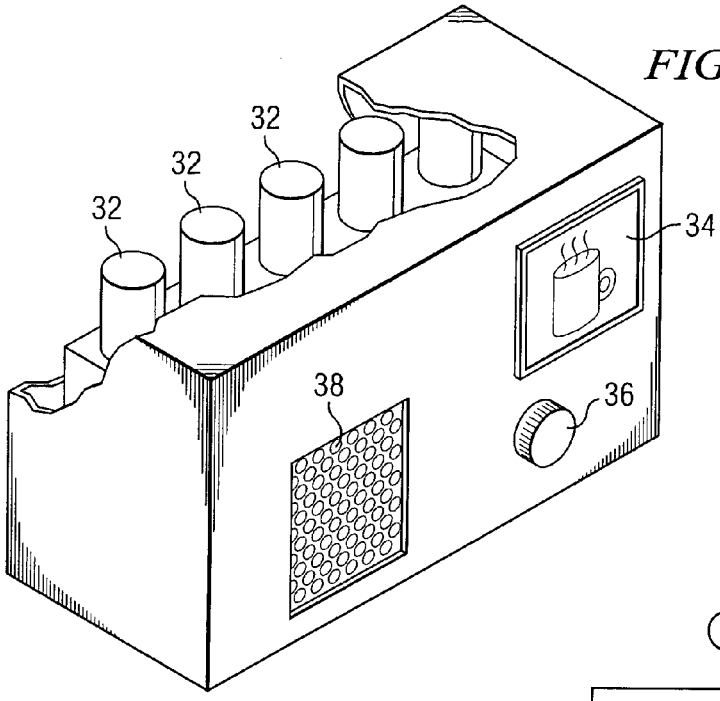
FIG. 3 is a block diagram illustrating one embodiment of an aroma station that may be used with the system of FIG. 1.

FIG. 3 illustrates another embodiment of aroma station 30 where indicator 34 may include a screen display. For example, indicator 34 may comprise a screen suitable for displaying a picture that represents the aroma, a text identifying the aroma, or any other illustration suitable to display the selected aroma. Indicator 34 may display the selected aroma using a color illustration or a black and white illustration. Although a screen has been described in this embodiment, it is understood that any other suitable display may be used as indicator 34.

Modifications, additions, or omissions may be made to aroma station 30 without departing from the scope of the invention. For example, selector 36 and indicator 34 may be omitted if the aroma chamber houses one container 32 and emits one aroma. As another example, selector 46 may be used to select more than one aroma 48. According to the embodiment described with reference to FIG. 1, an aroma selection may be received at controller 20 instead of using selector 36 at aroma box. Selector 26 may be controlled by controller 20 to select aroma 48 according to the aroma selection received at input 12. As yet another example, aroma station 30 may emit more than one aroma through vent 38. As yet another example, vent 38 may emit more than one aroma simultaneously. If the user desires to have more than one aroma released at the same time, aroma station 30 may include any suitable number of selectors 36. As yet another example, aroma station 30 may include more than one vent 38. Multiple vents 38 may allow for the emission of more than one aroma, simultaneously or at different times.

Figure 4:
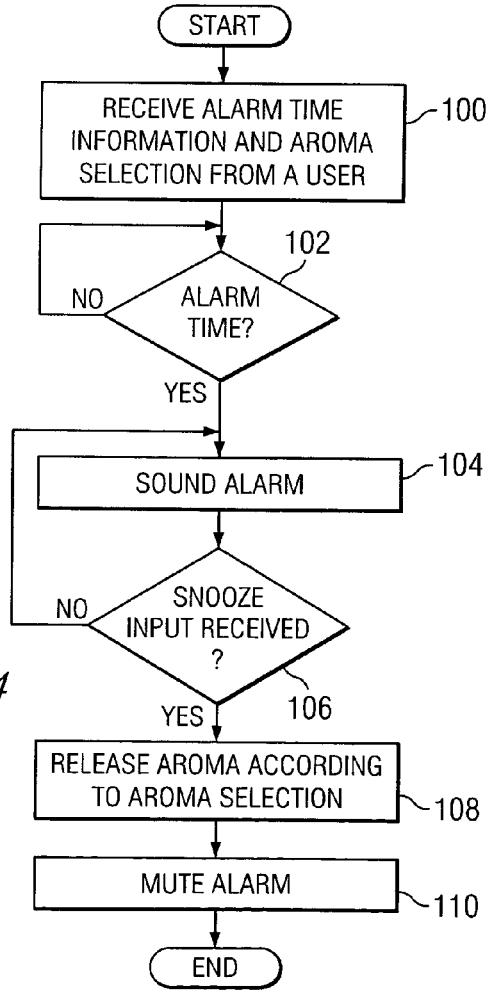
FIG. 4 is a flowchart illustrating a method for waking a person in accordance with one embodiment of the present invention.

FIG. 4 is a flowchart illustrating a method for waking a person. The method begins at step 100, where controller 20 receives information 12 from a user. As was described with reference to FIG. 1, controller 20 receives alarm time information and an aroma selection from the user. Controller 20 may also receive other suitable information 12 such as alarm type information, information to delay the alarm sounding, or any other suitable information that a user may input into controller 20. Processor 24 uses the alarm time information to determine the alarm time at which to sound alarm 46. Processor 24 may use the aroma selection to forward to aroma station 30 the selected aroma 48.

At step 102, controller 20 determines if it is alarm time. According to one embodiment, processor 24 may include a timer that checks if the current time is the alarm time. If the current time is not alarm time, the method returns to step 102 to keep checking. If the current time is alarm time, the method proceeds to step 104, where controller 20 sounds alarm 46.

After alarm 46 sounds, activator 40 may receive a snooze input from the user at step 106. As was described with reference to FIG. 1, the user may step on a floor mat equipped with pressure sensitive sensors that receives the snooze input from the user when the user steps on the floor mat. If the snooze input is not received at step 106, the method returns to step 104, where controller 20 continues sounding alarm 46.

If the snooze input is received at step 106, the method continues to step 108, where aroma station 30 releases aroma 48 according to the aroma selection. According to the illustrated embodiment, controller 20 generates a release aroma signal in response to the snooze input to initiate the release of aroma 48 at aroma station 30. For example, processor 24 may instruct aroma station 30 to release aroma 48 according to the aroma selection if response to the snooze input. Aroma station 30 may be located proximate to the user so aroma 48 may be diffused through vent 38 in such a way that the user may quickly sense aroma 48, which may result in the user being energized.

At step 110, controller 20 mutes alarm 46. According to the illustrated embodiment, controller 20 mutes alarm 46 in response to the snooze input. As was described with reference to FIG. 1, controller 20 may mute alarm 46 for a predetermined period of time before resuming sounding the alarm 46. For example, controller 20 may mute alarm 46 for a sufficient length of time such as 10 minutes so the user may have sufficient time to be energized by the aroma before disabling the subsequent sounding of alarm 46 by turning switch 26 in the off position. Controller 20 may mute alarm 46 for any other suitable period of time.

Modifications, additions, or omissions may be made to the method without departing from the scope of the invention. For example, releasing aroma 48 according to aroma selection at step 108 may be performed before receiving the snooze input at step 106. As another example, releasing aroma 48 at step 108 may be performed substantially simultaneously to muting alarm 46 at step 110. As yet another example, receiving information 12 from the user at step 100 may be omitted to allow controller 20 to operate with default information.

Certain embodiments of the invention may provide one or more advantages. For example, a user may stop snoozing an alarm clock by requiring the user to at least partially get up from bed to activate a snooze function that initiates the release of an energizing aroma that may result in the user being energized. With a traditional alarm, a user may not be motivated to perform the required tasks of the day. This device motivates the user to complete daily tasks by releasing an olfactory signal in addition to a traditional auditory signal. This combined alarm both energizes users and alerts the users of a specific time.

Although an embodiment of the invention and its advantages are described in detail, a person skilled in the art could make various alternations, additions, and omissions without departing from the spirit and scope of the present invention as defined by the appended claims.

What is claimed is:

1. A system for waking a person, comprising:

an input operable to receive an alarm time information and an aroma selection from a person;

an alarm operable to generate an audible signal when activated;

an aroma station operable to generate an olfactory signal when activated;

an activator operable to receive a snooze input from the person, the activator enclosed in a floor mat, the activator operable to be pressed and depressed by the person in order to generate the snooze input; and a controller coupled to the activator and the aroma station and operable to:

activate the audible signal in response to the alarm time information; and activate the aroma station in response to the snooze input and according to the aroma selection.

2. The system of claim 1, wherein:

the controller comprises one or more processors; and the one or more processors are operable to:

process the alarm time information; and set an alarm time using the alarm time information, the alarm time corresponding to a time at which the alarm generates the audible signal.

3. The system of claim 1, wherein:

the controller comprises one or more processors; and the one or more processors are operable to:

receive the snooze input from the activator;

mute the auditory signal in response to the snooze input; and generate a release aroma signal in response to the snooze input, the release aroma signal operable to initiate the release of the olfactory signal.

4. The system of claim 1, wherein the aroma station comprises one or more aroma storing devices, each aroma storing device comprising an aroma releasing material and operable to release the olfactory signal.

5. The system of claim 1, wherein the aroma station comprises a selector, the selector operable to receive an aroma selection.

6. The system of claim 5, wherein the aroma station further comprises an indicator operable to display the aroma selection.

7. The system of claim 1, wherein the olfactory signal comprises one or more aromas operable to energize the person.

8. The system of claim 1, wherein the olfactory signal comprises one of a selected bacon aroma, coffee aroma, sausage aroma, or hot chocolate aroma.

9. A method for waking a person, comprising:

receiving an alarm time information and an aroma selection from a person;

generating an audible signal in response to the alarm time information;

generating an olfactory signal at an aroma station when activated;

receiving a snooze input from the person at an activator, the activator enclosed in a floor mat, the activator operable to be pressed and depressed by the person in order to generate the snooze input; and activating the aroma station in response to the snooze input and according to the aroma selection.

10. The method of claim 9, further comprising:

processing the alarm time information; and setting an alarm time using the processed alarm time information, the alarm time corresponding to a time at which an alarm generates the audible signal.

11. The method of claim 9, further comprising:

muting the auditory signal in response to the snooze input; and generating a release aroma signal in response to the snooze input, the release aroma signal operable to initiate the release of the olfactory signal.

12. The method of claim 9, wherein the aroma station comprises one or more aroma storing devices, each aroma storing device comprising an aroma releasing material and operable to release the olfactory signal.

13. The method of claim 9, further comprising receiving an aroma selection at the aroma station.

14. The method of claim 13, further comprising displaying the aroma selection.

15. The method of claim 9, wherein releasing the olfactory signal energizes the person.

16. The method of claim 9, wherein the olfactory signal comprises one of a selected bacon aroma, coffee aroma, sausage aroma, or hot chocolate aroma.

17. A system for releasing an aroma comprising:

means for receiving an alarm time information and an aroma selection from a person;

means for generating an audible signal in response to the alarm time information;

means for generating an olfactory signal at one or more aroma stations when activated;

means for receiving a snooze input from the person at an activator, the activator enclosed in a floor mat, the activator operable to be pressed and depressed by the person in order to generate the snooze input; and means for activating the aroma station in response to the snooze input and according to the aroma selection.

18. A system for waking a person, comprising:

an input operable to receive an alarm time information and an aroma selection from a person;

an alarm operable to generate an audible signal when activated;

an aroma station operable to generate an olfactory signal when activated, the olfactory signal comprising one of a selected bacon aroma, coffee aroma, sausage aroma, or hot chocolate aroma, the aroma station comprising:

one or more aroma storing devices, each aroma storing device comprising an aroma releasing material and operable to release the olfactory signal;

a selector, the selector operable to receive an aroma selection; and an indicator operable to display the aroma selection;

an activator operable to receive a snooze input from the person, wherein the activator is enclosed in a floor mat, the activator further operable to be pressed and depressed by the person in order to generate the snooze input; and a controller coupled to the activator and the aroma station and comprising one or more processors operable to:

process the alarm time information;

set an alarm time using the alarm time information, the alarm time corresponding to a time at which the alarm generates the audible signal;

activate the audible signal in response to the alarm time information;

activate the aroma station in response to the snooze input and according to the aroma selection;

receive the snooze input from the activator;

mute the auditory signal in response to the snooze input; and generate a release aroma signal in response to the snooze input, the release aroma signal operable to initiate the release of the olfactory signal.

* * * * *